United States Patent [19]

Portmann

[11] Patent Number: 4,757,734

[45] Date of Patent: Jul. 19, 1988

[54] BALANCING MEANS IN A PUNCHING MACHINE

[75] Inventor: August T. Portmann, Arbon, Switzerland

[73] Assignee: Bruderer AG, Frasnacht-Arbon, Switzerland

[21] Appl. No.: 13,972

[22] Filed: Feb. 12, 1987

[30] Foreign Application Priority Data

Apr. 28, 1986 [CH] Switzerland ..... 1727/86

[51] Int. Cl.[4] ..... B30B 1/06; B26D 5/14

[52] U.S. Cl. ..... 83/615; 83/628; 83/632; 100/282; 74/603

[58] Field of Search ..... 83/615, 748, 628, 630, 83/632; 100/282, 283, 214; 74/44, 49, 51, 55, 603, 571 M; 72/441, 452

[56] References Cited

U.S. PATENT DOCUMENTS

| | | | |
|---|---|---|---|
| 2,321,325 | 6/1943 | Sherman et al. | 83/615 |
| 3,450,038 | 6/1969 | Kraft et al. | 83/615 X |
| 3,611,918 | 10/1971 | Marsh et al. | 100/214 |
| 4,156,387 | 5/1979 | Portmann | 100/282 |
| 4,276,823 | 7/1981 | Rotzler | 100/282 |
| 4,674,357 | 6/1987 | Sugawara et al. | 100/282 |

FOREIGN PATENT DOCUMENTS

| | | | |
|---|---|---|---|
| 2241538 | 4/1973 | Fed. Rep. of Germany | 83/615 |
| 1390420 | 4/1975 | United Kingdom . | |
| 1502193 | 2/1978 | United Kingdom . | |
| 2014509 | 8/1979 | United Kingdom . | |
| 2090189 | 7/1982 | United Kingdom . | |

*Primary Examiner*—E. R. Kazenske
*Assistant Examiner*—Eugenia A. Jones
*Attorney, Agent, or Firm*—Ladas & Parry

[57] ABSTRACT

In a punching machine, a yoke is supported on an eccentric section of the crankshaft. The yoke is designed to counterbalance the rotating forces. Both ends of the yoke are pivotably connected to connecting rods. Both connecting rods are pivotably connected, in turn, to a vertically-guided counterbalancing weight to counterbalance the oscillating forces.

3 Claims, 2 Drawing Sheets

BALANCING MEANS IN A PUNCHING MACHINE

BACKGROUND OF THE INVENTION

1. Field of the Invention

The present invention relates to a means for a balancing the masses of a punching machine having a crank- or eccentric, respectively, shaft supporting via frictionless bearings the punch connecting rods which are pivotably connected to the ram of the punching machine, the mass balancing means having counterbalance weight means guided for vertical movement in the punching machine frame and operative for a counterbalancing of the oscillating forces, and having further counterbalance weight means operative for a counterbalancing of the rotating forces.

2. Description of the Prior Art

The oscillating counterbalancing weights of known punching machines are commonly driven by a rod. To this end one end of a respective rod is pivotably mounted to the oscillating counterbalance weight and oscillates in operation, whereagainst the opposite end of this rod is supported on a crankshaft and accordingly rotates in operation. This crankshaft drives also the punch connecting rod driving the ram of the punching machine.

In order to counterbalance the rotating forces relatively large masses are necessary and conclusively the rotating portion of the rod pivotably mounted to the counterbalancing weight of known punching machines is exceedingly heavy. This leads, however, to the fact that in case of lateral pivoting movements of this rod extremely large plus/minus moments are generated in the rod, which moments are transmitted via the respective guiding means of the moving parts of such punching machines onto the machine frame. This leads conclusively to problems regarding the supporting of the machine on its respective foundation. A design incorporating a short rod with the object to decrease the lateral swinging out movements of the rod is due to design reasons hardly possible because such rod interconnects moving structural members, which members need a space in order to carry out their movements and accordingly certain demands are made regarding the length of such rod.

SUMMARY OF THE INVENTION

It is, accordingly, an object to provide a means for a balancing of the masses in punching machines, in which the counterbalance weight means operative for a counterbalancing of the rotating forces consists of a yoke supported by the crank- or eccentric, respectively, shaft; and the counterbalance weight means operative for a counterbalancing of the oscillating forces comprises a vertically guided counterbalance weight driven via two connecting rods pivotably mounted to respective end sections of the yoke.

BRIEF DESCRIPTION OF THE DRAWINGS

The present invention will be more fully understood by reference to the following detailed description thereof, when read in conjunction with the attached drawings, and wherein.

DESCRIPTION OF THE PREFERRED EMBODIMENT

Figure 1:
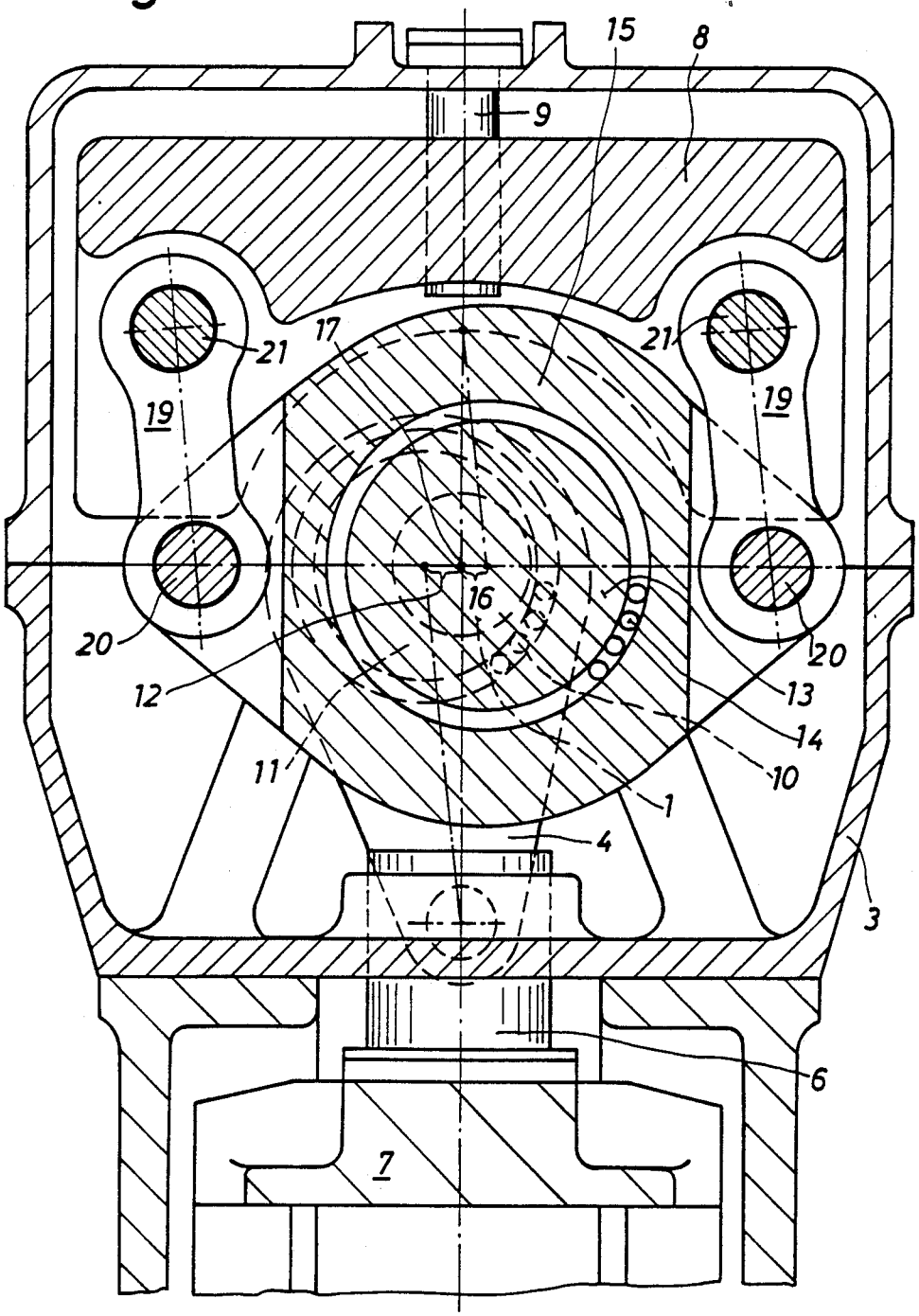
FIG. 1 is a view of a cross section through a part of a punching machine incorporating a means for the balancing of the masses.
Figure 2:
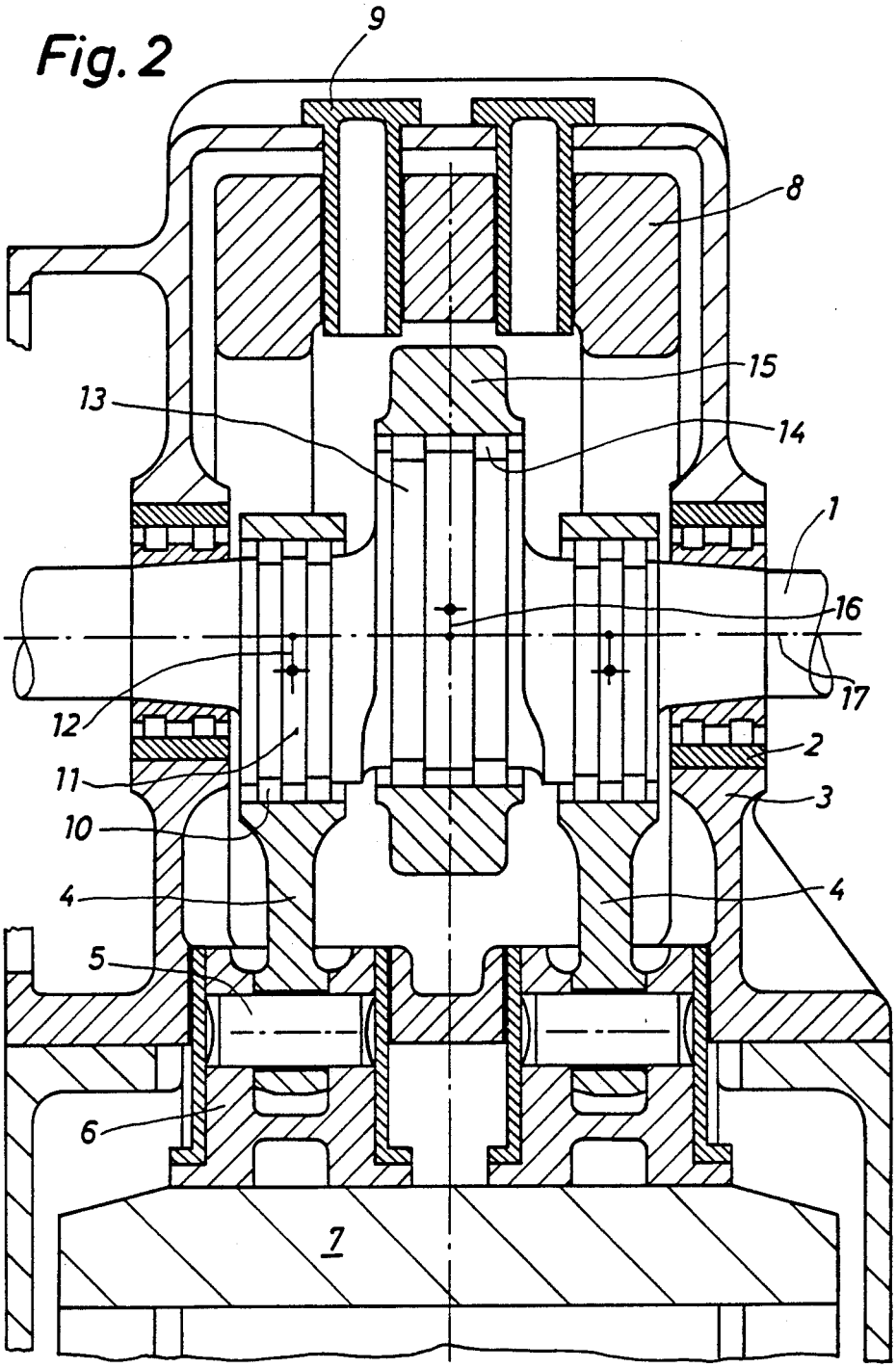
FIG. 2 is a view of a longitudinal section through the part of the machine illustrated in FIG. 1.

A crankshaft 1 is rotatably supported in a machine frame 3 by frictionless bearings 2 (see FIG. 2). Two ram or punch connecting rods 4 are supported eccentrically on the crankshaft, and the particulars of this will be entered into further below. The punch connecting rods 4 are respectively mounted pivotably on trunnions 5 on heads 6, which are vertically guided in the machine frame 3. A ram 7 is pivotably mounted to these heads 6. The shown embodiment is a high speed punching machine of two point drive design.

A counterbalance weight 8 is located above the crank. The counterbalance weight 8 counterbalances oscillating forces. The counterbalance weight 8 is guided for linear movement by two guide rods 9, which extend vertically therethrough from rigid mountings to the machine frame 3.

The punch connecting rods 4 are supported, by frictionless bearings 10, on respective eccentric sections 11 of the crankshaft 1. The eccentricity of the respective eccentric sections 11 is identified by the reference numeral 12.

Furthermore, yoke 15 is supported on a an eccentric section 13 of crankshaft 1 centrally between the punch connecting rods via frictionless bearings 14. The eccentric of this eccentric section 13 is identified by reference numeral 16.

The drawings disclose clearly that the eccentricity 16 of the eccentric section 13 which supports the yoke 15 is smaller than the eccentricity 12 of the eccentric sections 11 supporting the respective punch connecting rods 4.

This design makes it possible to keep the rotating masses and, importantly, the stopping angle of the machine extremely small, because the eccentricity 12 which determines the stroke of the ram 7 is set, for instance, by the punching tools and only the eccentricity 16 can be selected with regard to the design of the machine.

It is to be noted, furthermore, that relative to the center axis 17 of the crankshaft 1, the eccentricities 12 and 16 are diametrically opposed, i.e. by an angle of 180°.

It is to be noted, furthermore, that the frictionless bearings 14 have a relatively large diameter. This leads to the condition that the yoke bearings 14 are not subjected to point loading, but rather to loop loading and, accordingly, have a much longer lifetime.

The yoke 15 is, therefore, designed as a counterbalancing weight which balances the rotating forces. Connecting rods 19 are pivotably mounted, via pivot pins 20, to respective lateral end sections 18 of yoke 15. At their opposite ends, these connecting rods 19 are pivotably mounted, via pivot pins 21, to the counterbalance weight 8.

The stroke-connecting-rod ratio $$\left(= \frac{\text{radius of crank}}{\text{length of connecting rod}}\right)$$

of the connecting rods 19 located between the yoke 15 and the counterbalance weight 8 is at least approximately the same as the stroke-connecting-rod ratio of the punch connecting rods 4 located between the crankshaft 1 and the ram 7. Due to this design, the oscillating forces of the second order are balanced, too.

While there is shown and described a present preferred embodiment of the invention, it is to be distinctly understood that the invention is not limited thereto, but may be otherwise variously embodied and practiced within the scope of the following claims.

I claim:

1. A punching machine, comprising:

a machine frame;

a crankshaft rotatably supported on the machine frame, the crankshaft having eccentric sections;

two punch connecting rods, each for connection at one end to a ram, the opposite ends of the punch connecting rods being rotatably supported on respective eccentric sections of the crankshaft;

a counterbalance weight guided from the machine frame for linear movement counterbalancing oscillating forces;

a yoke rotatably supported on an eccentric section of the crankshaft between the punch connecting rods for counterbalancing rotating forces, the yoke having opposite lateral ends; and two counterbalance connecting rods each pivotably connected, at one end, respectively to one of the opposite lateral ends of the yoke and, at the opposite end, to the counterbalance weight.

2. The machine of claim 1, wherein the stroke-connecting-rod ratio of the two counterbalance connecting rods approximately equals, the stroke-connecting-rod ratio of the two punch connecting rods.

3. The machine of claim 1, wherein the eccentricity of the eccentric sections of the crankshaft supporting the punch connecting rods is larger than the eccentricity of the eccentric section of the crankshaft supporting the yoke.

* * * * *